US005557952A

United States Patent [19]

Sundell et al.

[11] Patent Number: 5,557,952

[45] Date of Patent: Sep. 24, 1996

[54] WASHING MACHINE AUGER SCREW WITH LIP

[75] Inventors: Robert E. Sundell, Clifton Park; Harold J. Jenkins, Amsterdam, both of N.Y.

[73] Assignee: General Electric Company, Schenectady, N.Y.

[21] Appl. No.: 513,241

[22] Filed: Aug. 10, 1995

[51] Int. Cl.[6] ..... D06F 17/10

[52] U.S. Cl. ..... 68/134

[58] Field of Search ..... 68/133, 134; 366/319

[56] References Cited

U.S. PATENT DOCUMENTS 2,034,527 3/1936 Nelson ..... 68/133

3,987,508 10/1976 Platt ..... 8/159

3,987,651 10/1976 Platt ..... 68/133

5,356,215 10/1994 Inoue et al. ..... 366/319 X

*Primary Examiner*—Philip R. Coe

*Attorney, Agent, or Firm*—Patrick K. Patnode; Donald S. Ingraham

[57] ABSTRACT

An auger for moving clothes downwardly in a washing machine includes a tubular housing and an auger screw spiraling therearound. Disposed along a distal edge of the auger screw is an auger lip which is inclined relative to the screw for impeding radially outward movement of clothes in the washing machine.

13 Claims, 2 Drawing Sheets

WASHING MACHINE AUGER SCREW WITH LIP

The present invention relates generally to clothes washing machines, and, more specifically, to a washing machine having a vertical agitator and auger operatively joined together.

BACKGROUND OF THE INVENTION

Clothes washing machines include either vertical or horizontal agitators for moving clothes during the washing operation. In the horizontal washing machine, the agitator continually rotates in one direction causing the clothes therein to tumble during the washing operation in a soap and water cleaning solution. In the vertical washing machine, the agitator reciprocates or oscillates to continually change its rotation direction for moving the clothes to effect cleaning thereof in the cleaning solution.

In order to improve clothes moving in the vertical washing machine, it is known to also include an auger having a spiraling vane or screw disposed coaxially atop the agitator. Disposed between the auger and the agitator is a conventional ratchet drive mechanism which converts the oscillating, bidirectional rotation of the agitator into unidirectional rotation of the auger so that the auger screw is rotated for pulling the clothes downwardly in operation in the cleaning solution for improving the effectiveness of the washing operation. A typical auger screw extends substantially perpendicularly radially outwardly from the centerline axis of the auger in order to effectively propel the clothes downwardly along the auger itself during operation.

More specifically, the coaxial agitator and auger are disposed in the center of a tubular basket in the washing machine which is substantially filled with the cleaning solution and the laundry to be washed. During operation, the agitator oscillates back and forth, with the vanes thereon pumping or moving the clothes radially outwardly toward the inner wall of the basket. In turn, the clothes are circulated vertically upwardly along the basket wall to the top of the basket where the circulation turns radially inwardly toward the top of the auger. The auger vane enhances clothes circulation by propelling the clothes downwardly along the auger for returning the clothes to the agitator for completing one turnover cycle. The more turnover cycles of the clothes during the entire washing operation, the more effective is the cleaning thereof.

Although the auger screw enhances clothes turnover during the washing operation, it has been observed that in addition to propelling the clothes downwardly along the auger itself, the clothes are also propelled radially outwardly along the auger screw which inhibits the free movement of the clothes upwardly along the basket inner wall and, in turn, prevents achievement of the maximum turnover of clothes in the washer.

SUMMARY OF THE INVENTION

An auger for moving clothes downwardly in a washing machine includes a tubular housing and an auger screw spiraling therearound. Disposed along a distal edge of the auger screw is an auger lip which is inclined relative to the screw for impeding radially outward movement of clothes in the washing machine.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
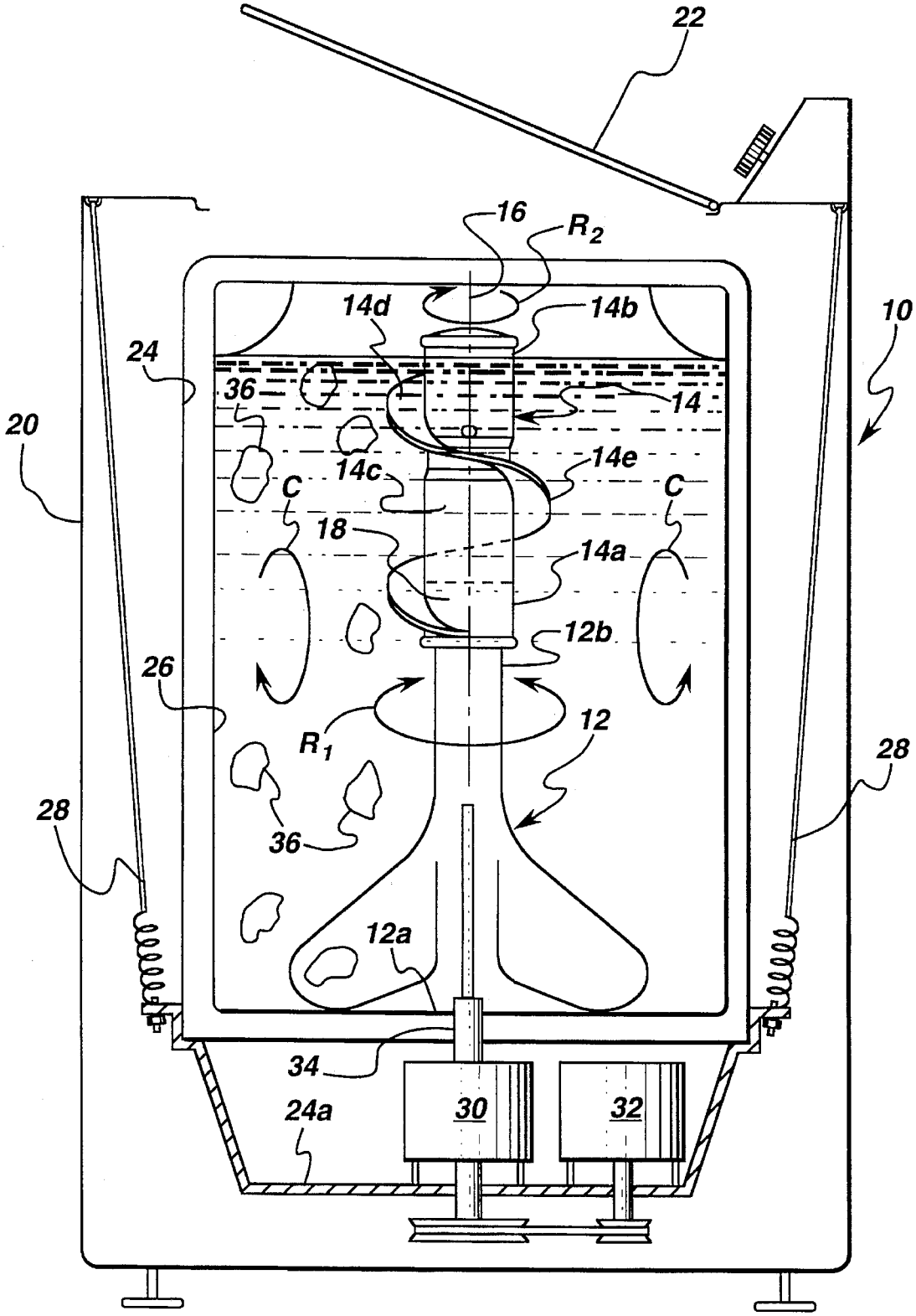
FIG. 1 is a schematic, elevational, partly sectional view of an exemplary vertical agitator washing machine including a coaxial clothes auger joined thereto, and having a screw and lip in accordance with one embodiment of the present invention.

Illustrated schematically in FIG. 1 is an exemplary clothes washing machine 10 having a clothes agitator 12 disposed coaxially with a clothes auger 14 about a vertical, axial centerline axis 16. A drive mechanism 18, which may be a ratchet or clutch mechanism, joins the auger 14 to the agitator 12 for converting bidirectional rotary oscillation $R_1$ of the agitator 12 to unidirectional rotary motion or rotation $R_2$ of the coaxially adjoining auger 14.

In the exemplary embodiment illustrated in FIG. 1, the washing machine 10 includes a conventional housing or cabinet 20 with a central opening at its top having a hinged lid 22 which may be opened or closed for loading or unloading clothes, as well as for providing the soap or detergent into the washing machine 10. Disposed inside the housing 20 is a conventional tub 24 open at its top end and configured for containing the washing water therein. Inside the tub 24 is a conventional perforated basket 26 within which are centrally disposed the agitator 12, auger 14, and connecting drive mechanism 18 which are effective for moving clothes placed therein in a soap and water cleaning solution. The tub 24, as well as the components therein, is conventionally supported in the housing 20 by a plurality of spring suspensions 28.

Suspended from the bottom of the tub 24 is an integral frame **24*a* which supports a conventional transmission 30 and electrical motor 32 operatively joined together by a pulley and belt system. The motor 32 is effective for driving the transmission 30 for oscillating a conventional drive shaft 34 joined to the agitator 12** for imparting the desired bidirectional rotation $R_1$ thereto.

As shown in FIG. 1, the agitator 12 includes a bottom or proximal end **12*a* which is disposed at the bottom of the basket 26 and through which the drive shaft 34 extends axially upwardly and is conventionally fixedly joined to the agitator 12. The agitator 12 includes a top distal end 12*b* which is inserted into a bottom or proximal end 14*a* of the 5 auger 14. The auger 14 has a top or distal end 14*b*, and a hollow, tubular housing 14*c* that extends vertically between the bottom and top ends 14*a,b* coaxially about the centerline axis 16**.

In accordance with one embodiment of the present invention, an auger vane or screw **14*d* extends radially outwardly from the outer surface of the auger housing 14*c* and spirals therearound in either a left-hand spiral as illustrated in FIG. 1, or alternatively in a right-hand spiral if desired. The drive mechanism 18 is disposed inside the auger housing 14*c* and may take any conventional form including a ratchet mechanism or clutch mechanism for imparting unidirectional, rotation $R_2$ to the auger 14 from the agitator 12 for pulling or pushing clothes or laundry 36 vertically downwardly along the auger 14 during the washing operation. For the left-hand auger screw 14d illustrated in FIG. 1, the drive mechanism 18 imparts clockwise rotation to the auger 14 for pushing the clothes 36 downwardly. In an alternate embodiment having a right-hand auger screw 14***d*, the drive mechanism 18 would be suitably configured for imparting counterclockwise rotation to the auger 14, again for using the auger screw 14d for pushing the clothes 36 downwardly along the outer surface of the auger housing 14*c*.

The basic circulation of the clothes 36 in the cleaning solution in the washer basket 26 is illustrated in FIG. 1 and designated C. The vanes of the agitator 12 conventionally propel the clothes 36 radially outwardly therefrom toward the inner surface of the basket 26. In turn, the clothes 36 are propelled upwardly along the inner wall of the basket 26 toward the top thereof. The clothes 36 then turn radially inwardly toward the centerline axis 16 and are circulated vertically downwardly toward the agitator 12. The auger screw 14d improves the vertically downward travel of the clothes 36 toward the agitator 12, and therefore improves the number of complete turnovers, or completion of cycles of circulation C, for improving cleaning of the clothes 36. However, a conventional auger screw has a smooth outer surface and extends typically perpendicularly outwardly from the centerline axis 16, and therefore also propels the clothes 36 radially outwardly toward the basket 26. Collisions between the downward and upward travelling clothes 36 occur which therefore prevent maximum turnover of the clothes during operation.

Figure 2:
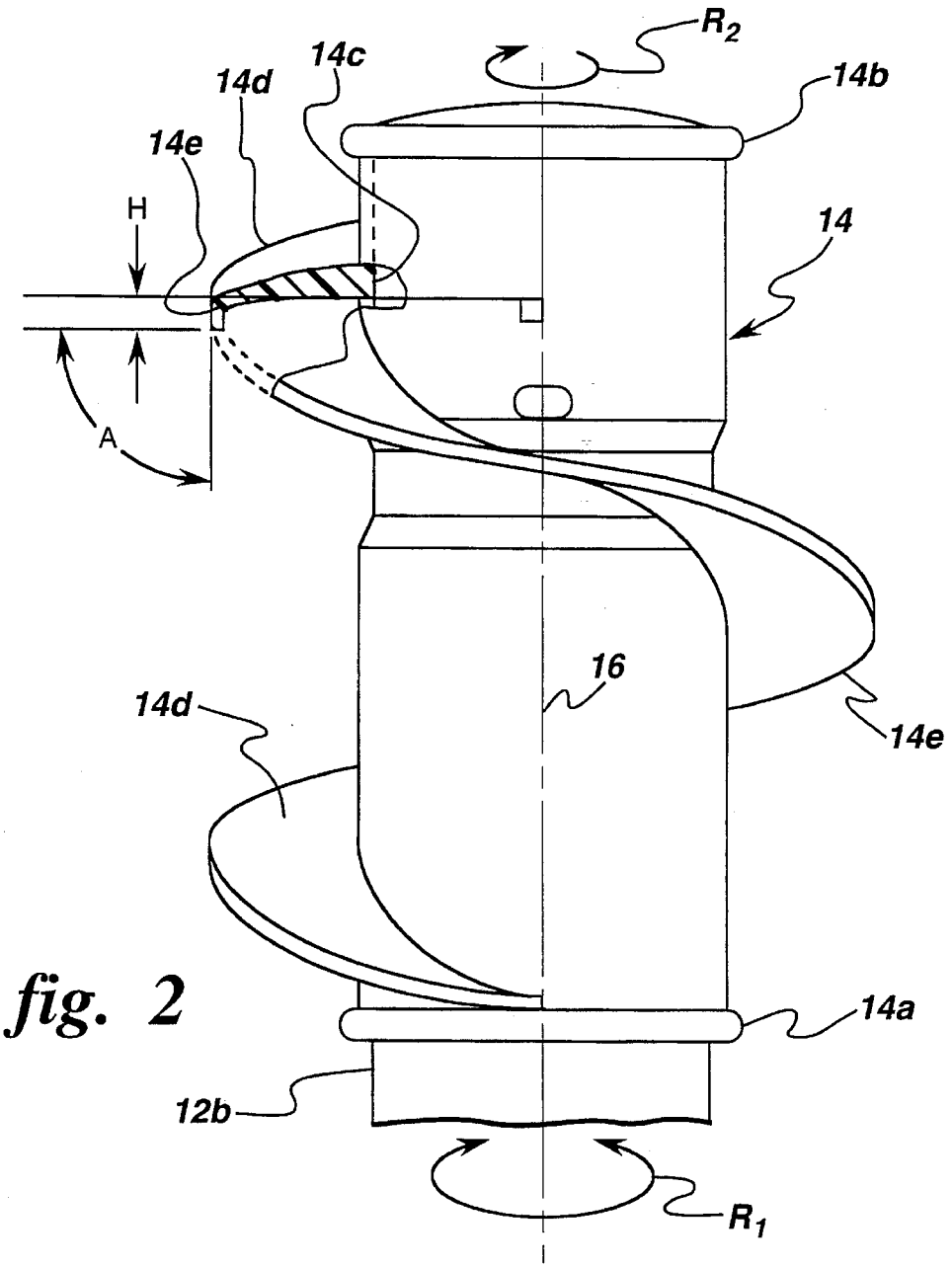
FIG. 2 is an enlarged, partly sectional view of the auger and screw illustrated in FIG. 1, with the lip extending downwardly relative thereto.

The auger 14 in accordance with an exemplary embodiment of the present invention is illustrated in more particularity in FIG. 2. The auger screw 14d itself is conventional in configuration and extends substantially perpendicularly radially outwardly from the centerline axis 16. The auger screw 14*d* has a proximal edge which is fixedly integrally joined to the housing 14*c*, and includes an opposite, radially outward distal edge which is unsupported. The auger 14 is preferably made of a suitable plastic such as polypropylene, with the auger screw 14*d* being integrally molded with the housing 14*c*.

In accordance with the present invention, an auger lip 14*e* is disposed integrally along the distal edge of the auger screw 14*d*, and is inclined downwardly relative to the auger screw 14*d* at a suitable inclination angle A for impeding or inhibiting radially outward movement of the clothes 36 to enhance downward movement thereof and increase clothes turnover for improving the cleaning operation. The auger lip 14*e* is preferably formed or molded integrally with the auger housing 14*c* and auger screw 14*d* during manufacture, and is therefore formed of the same material such as polypropylene.

In the exemplary embodiment illustrated in FIG. 2, the lip 14*e* is integrally joined to the distal edge of the screw 14*d* to define a generally right-angle corner thereat. The lip 14*e* has a height H measured downwardly from the lower surface of the auger screw 14*d* which may be suitably selected based on individual auger designs for maximizing restraint of the radially outward movement of the clothes 36 along the underside of the auger screw 14*d* as the clothes 36 are propelled vertically downwardly. By extending the lip 14*e* vertically downwardly toward the auger bottom end 14*a*, the clothes 36 which are being propelled downwardly by the lower surface of the auger screw 14*d* are also effectively impeded against radially outward travel therealong.

In the exemplary embodiment illustrated in FIG. 2, the lip 14*e* is preferably continuous for substantially the entire spiralling length of the auger screw 14*d*, with the lip 14*e* being smooth and free from projections, unevenness, or undulations.

Figure 3:
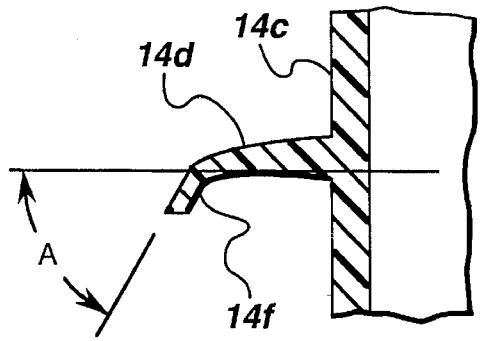
FIG. 3 is an enlarged, transverse sectional view through the auger and screw illustrated in FIG. 1, including a lip in accordance with another embodiment of the present invention which is inclined at an acute angle.

FIG. 3 illustrates an alternate embodiment of the lip designated 14*f*, wherein the lip 14*f* is inclined at an acute angle A relative to the auger screw 14*d*, and diverges radially outwardly in the vertical downward direction. In this way, the included angle of the corner defined by the lip 14*f* and the auger screw 14*d* is greater than 90° for allowing a smoother transition of the clothes 36 as they slide radially outwardly along the underside of the auger screw 14*d* and auger lip 14*e*.

The underside of the auger screw 14*d* is preferably substantially perpendicular to the centerline axis 16 for maximizing the downward propulsion of the clothes 36 during operation. The inclination angle A of the lip 14*e* and the height H thereof may be varied as desired for impeding radially outward movement of the clothes 36 under the auger screw 14*d* while maintaining effective downward travel of the clothes 36. The resulting improved turnover of the clothes 36 during the washing operation is effective for improving cleaning of the clothes 36.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

What is claimed is:

1. An auger for moving clothes downwardly in a washing machine comprising:

a tubular housing;

an auger screw extending radially outwardly from said housing and spiralling therearound, and including a proximal edge integrally joined to said housing, and an opposite distal edge; and an auger lip disposed along said distal edge of said auger screw, and being inclined relative to said auger screw for impeding radially outward movement of said clothes.

2. An auger according to claim 1 wherein said auger lip is integrally joined to said distal edge of said auger screw to define a corner thereat.

3. An auger according to claim 2 further comprising a bottom end and an opposite top end, and wherein said auger lip extends downwardly towards said auger bottom end.

4. An auger according to claim 3 wherein said auger lip is continuous with said spiralling auger screw.

5. An auger according to claim 3 wherein said auger lip is smooth.

6. An auger according to claim 3 wherein said auger lip is inclined at an acute angle relative to said auger screw.

7. An auger according to claim 3 wherein said auger lip is inclined perpendicularly relative to said auger screw and parallel to said auger housing.

8. A machine for washing clothes comprising:

a basket for receiving said clothes in a liquid cleaning solution;

a bidirectional clothes agitator disposed coaxially inside said basket;

a unidirectional clothes auger disposed coaxially atop said agitator;

a drive mechanism for converting rotary oscillation of said agitator to unidirectional rotation of said auger; and said auger including:

a tubular housing;

an auger screw extending radially outwardly from said housing and spiralling therearound, and including a proximal edge integrally joined to said housing, and an opposite distal edge; and an auger lip disposed along said distal edge of said auger screw, and being inclined relative to said auger screw for impeding radially outward movement of said clothes.

9. An auger for moving clothes downwardly in a washing machine comprising:

a tubular housing;

an auger screw extending radially outwardly from said housing and spiraling therearound, and including a proximal edge integrally joined to said housing, and an opposite distal said auger in combination with a bidirectional clothes agitator disposed coaxially therewith, with a drive mechanism disposed therebetween for convening rotary oscillation of said agitator to unidirectional rotation of said auger; and an auger lip disposed along said distal edge of said auger screw, and being inclined relative to said auger screw for impeding radially outward movement of said clothes.

10. A machine for washing clothes comprising:

a basket for receiving said clothes in a liquid cleaning solution;

a bidirectional clothes agitator disposed coaxially inside said basket;

a unidirectional auger disposed coaxially atop said agitator;

a drive mechanism for converting rotary oscillation of said agitator to unidirectional rotation of said auger; and said auger including:

a tubular housing;

an auger screw extending radially outwardly from said housing and spiraling therearound, and including a proximal edge integrally joined to said housing, and an opposite distal edge;

an auger lip disposed along said distal edge of said auger screw, and being inclined relative to said auger screw for impeding radially outward movement of said clothes;

said auger including a bottom end, and an opposite top end; and said auger lip is integrally joined to said auger screw to define a corner thereat which extends downwardly toward said auger bottom end.

11. A washing machine according to claim 10 wherein said lip is inclined at an acute angle relative to said auger screw.

12. A washing machine according to claim 10 wherein said auger lip is inclined perpendicularly relative to said auger screw and parallel to said auger housing.

13. A washing machine according to claim 10 wherein said auger lip is smooth and continuous with said spiraling auger screw.

* * * * *